US005858127A

United States Patent [19]

Ott et al.

[11] Patent Number: 5,858,127

[45] Date of Patent: Jan. 12, 1999

[54] METAL ALLOYS AND BRAKE DRUMS MADE FROM SUCH ALLOYS

[75] Inventors: William E. Ott, Rockford; Reginal A. Pete, Caledonia; Laxmi C. Tandon, Rockford, all of Ill.

[73] Assignee: Gunite Corporation, Rockford, Ill.

[21] Appl. No.: 873,956

[22] Filed: Jun. 12, 1997

Related U.S. Application Data

[63] Continuation-in-part of Ser. No. 691,999, Aug. 2, 1996, abandoned.

[51] Int. Cl.[6] ..... C22C 37/04; C22C 37/06

[52] U.S. Cl. ..... 148/321; 420/13; 420/15; 420/16; 420/17

[58] Field of Search ..... 148/321; 420/13, 420/15–17

[56] References Cited

U.S. PATENT DOCUMENTS 4,501,612 2/1985 Stefonescu et al. ..... 420/28
4,767,278 8/1988 Enderlein, Jr. ..... 416/241 B
4,990,194 2/1991 Obata et al. .

FOREIGN PATENT DOCUMENTS 569354 1/1981 Japan ..... 420/13
5754246 3/1982 Japan ..... 420/13
2079315 1/1982 United Kingdom ..... 420/17

*Primary Examiner*—Deborah Yee
*Attorney, Agent, or Firm*—Watov & Kipnes, P.C.

[57] ABSTRACT

A metal alloy, structures made from the same, and methods of making the same, especially brake drums containing at least about 50% by weight of a ferritic matrix, up to 50% by weight of pearlitic iron, graphite including at least 10% by weight of nodular graphite, compacted graphite and no more than 20% by weight of flake graphite, and less than about 2.10% by weight of silicon.

20 Claims, 1 Drawing Sheet

METAL ALLOYS AND BRAKE DRUMS MADE FROM SUCH ALLOYS

This application is a Continuation-in-part of case Ser. No. 08/691,999, now abandoned.

FIELD OF THE INVENTION

The present invention is directed to metal alloys and methods of making same based on a ferritic matrix which contains pearlitic iron and graphite in amounts which enable the production of lightweight brake drums having high strength and exceptional heat conductivity properties.

BACKGROUND OF THE INVENTION

Brake drums are cast gray iron drums attached to a wheel or a shaft so that its motion may be retarded by the application of an external band or internal brake shoes. Brake drums, especially those made for the trucking industry, must be durable and capable of rapidly and effectively dissipating the heat that builds up when the external band or shoe is applied during braking operations.

Cast gray iron has been the material of choice for producing brake drums. This material exhibits high strength and is resistant to wear under high stress conditions. In addition, cast gray iron readily dissipates heat and is ideally suited for the production of brake drums.

In recent years there has been a concerted effort to increase the efficiency of automotive vehicles, including but not limited to, the reduction of weight without loss of performance. Efforts have been made to employ lightweight materials for the body of automotive vehicles as well as for functioning parts of the vehicle. For example, fiberglass has been used to replace heavier steel and cast gray iron in portions of the body of the vehicles. In addition, aluminum has been used to fabricate engines to replace engines made of cast gray iron.

As previously indicated, cast gray iron has been used to produce brake drums. This material, however, is heavy and makes brake drums a significant contributor to the weight of an automotive vehicle. It would therefore be a significant advance in the art of producing automotive vehicles and particularly for the production of brake drums if a material could be developed which performed at least as well as cast gray iron but was significantly lighter than this material in the production of brake drums.

SUMMARY OF THE INVENTION

The present invention is generally directed to a metal alloy having excellent strength and high heat conductivity which is particularly suited to the manufacture of lightweight structures, especially brake drums. In particular, the metal alloy of the present invention comprises:

a) at least about 50% by weight of a ferritic matrix based on the total weight of the metal alloy;

b) up to about 50% by weight of pearlitic iron based on the total weight of the metal alloy;

c) graphite comprising at least about 10% by weight of nodular graphite, compacted graphite, and no more than 20% by weight of flake graphite wherein the tensile strength of the metal alloy is at least about 50,000 psi; and d) less than about 2.10% by weight of silicon based on the total weight of the metal alloy.

In a preferred form of the invention, the metal alloy contains controlled amounts of selected elements including magnesium, manganese, sulfur, phosphorus, chromium and copper. In addition, the preferred alloy exhibits, a minimum yield strength of about 35,000 psi and/or a Brinell Hardness value in the range of from about 143 to 217.

Structures formed from the metal alloy and especially brake drums as well as methods of forming the metal alloy are also encompassed by the present invention.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a metal alloy principally containing a ferritic matrix and pearlitic iron dispersed therein. Minor amounts of graphite, in the form of nodular graphite, compacted graphite, with small amounts of flake graphite, if any, are also present. The resulting alloy when formed into a structure such as a brake drum provides the structure with high strength and acceptable heat conductivity, while reducing the weight of the structure by at least 17% over conventional cast gray iron structures. Brake drums fabricated of the present alloy can provide longer service life than currently used brake drums.

As used herein the term "ferritic matrix" shall generally refer to a body centered cubic form of iron having ferrimagnetic properties (also known as ferrite). Ferrite can contain other metals, typically divalent metals such as manganese, copper, nickel and cobalt. Ferrite provides the matrix needed to stabilize the other essential materials employed in the present alloy.

The term "pearlite" (also known as pearlitic iron) shall mean a microconstituent of steel and cast-iron comprising an intimate mixture of ferrite and cementite. In particular, pearlite is a lamellar structure comprised typically of alternating layers of ferrite and cementite which contains graphite. Pearlitic iron exhibits greater strength than ferrite but possesses lower heat conductivity than ferrite.

The term "nodular graphite" shall mean graphite in spheroidal form. Nodular graphite increases both the tensile strength and ductility of the alloy.

"Compacted graphite" shall mean graphite which is in a form between flake graphite and nodular graphite. This form of graphite improves heat conductivity of the alloy compared to nodular graphite.

"Flake graphite" shall mean an irregular shaped particle of graphite, usually appearing in the shape of a curved plate, such as found in gray cast iron.

In accordance with the present invention, the metal alloy contains a ferritic matrix having dispersed therein pearlitic iron and selected forms of graphite in amounts which enable the production of structures exhibiting high strength and excellent heat conductivity. In addition, the weight of optional silicon in the alloy is limited to insure desirable heat conductivity for the alloy. The weight of such structures produced with the present alloy is significantly less than the weight of identical structures made of cast gray iron. This is because the present alloy exhibits a higher degree of strength than cast gray iron. Therefore less material is used per unit structure which results in lower weight.

Figure 1:
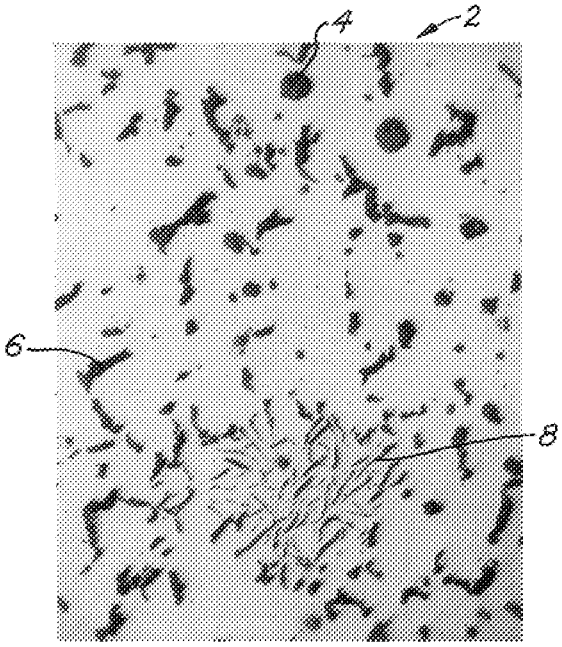
FIG. 1 is a photomicrograph of a metal alloy in accordance with the present invention showing the various forms of graphite.

Referring to FIG. 1 there is shown a photomicrograph of a metal alloy in accordance with the present invention in which the alloy has not been acid treated so as to show only the various forms of graphite. More specifically, the alloy 2 is comprised of nodular graphite 4 which typically appears in the form of spheres. Nodular graphite is present in an amount of at least 10% by weight based on the total weight of graphite.

Compacted graphite appears in the form of generally dense irregular shapes including rod-like structures. Compacted graphite is designated in FIG. 1 by the numeral 6. The amount of compacted graphite will vary depending on the amounts of nodular and flake graphite. It is preferred that the amount of compacted graphite be about the same as the amount of nodular graphite. In a preferred form of the invention the total amount of graphite present in the metal alloy is no more than about 12% by volume based on the total volume of the alloy, preferably from about 10 to 12% by volume.

Flake graphite, shown by numeral 8 in FIG. 1, typically has an irregular shape most closely resembling curved plates. The amount of flake graphite in the present alloy does not exceed about 20% by weight based on the total weight of graphite in the alloy.

The various forms of graphite shown in FIG. 1 are dispersed in a ferritic matrix and pearlite. The amount of the ferritic matrix is at least 50% by weight based on the total weight of the metal alloy. Pearlite is present in an amount of up to 50% by weight based on the total weight of the metal alloy.

Figure 2:
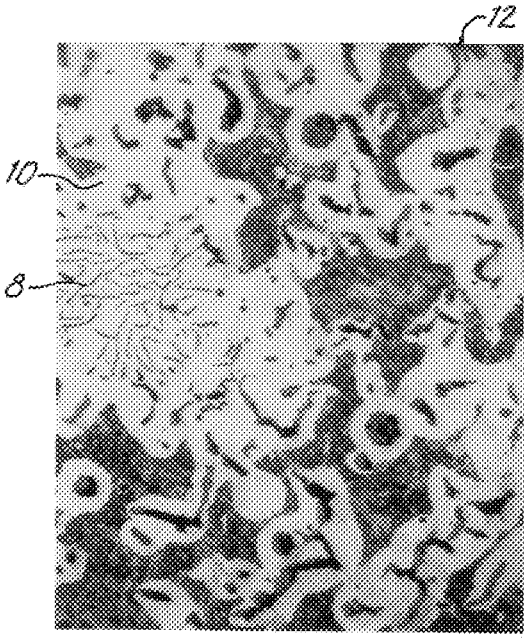
FIG. 2 is a photomicrograph of a metal of a metal alloy in accordance with the present invention which has been acid etched to show the various forms of graphite and the matrices containing the same.

Referring to FIG. 2, there is shown an embodiment of a metal alloy in accordance with the present invention in which the graphite described above is embedded in a ferritic matrix 10 and pearlite 12. More specifically as shown in FIG. 2, nodular graphite 4 is typically surrounded by the ferritic matrix 10. Flake graphite is also shown dispersed within the ferritic matrix 10, which has dispersed therein pearlite 12.

The proper balance of the principal components of the present alloy and the excellent properties associated therewith is facilitated by limiting certain elements in the alloy to specified amounts. For example, manganese, copper, chromium, and phosphorus are all implicated in the formation of pearlite. Therefore, in accordance with the present invention the amount of pearlite in the alloy is dependent on part on controlling the amount of these elements. In addition, control of the amount of manganese, copper and phosphorus prevents the alloy from being less heat conducting.

The metal alloy of the present invention comprises at least about 50% of a ferritic matrix based on the total weight of the alloy. The preferred amount of the ferritic matrix is in the range of from about 50 to 80% by weight.

Pearlitic iron contains graphite in nodular, compacted and flake form. The amount of pearlitic iron in the present metal alloy is up to 50% by weight based on the total weight of the alloy, preferably from about 20 to 50% by weight.

Pearlitic ductile iron contains graphite wherein at least 80% of all graphite is in nodular form. Pearlitic compacted iron contains graphite wherein a maximum of 20% of the graphite is in nodular form. Nodular graphite provides ductility to the metal alloy while compacted graphite enhances the heat conductivity of the alloy. It has been found that the metal alloy of the present invention should contain at least about 10% by weight of the graphite in nodular form and preferably no more than about 20% by weight of flake graphite, with the balance being compacted graphite.

The amount of graphite in the present alloy should not exceed about 12% by volume. The preferred amount of graphite is typically in the range of from about 10 to 12% by volume. The presence of graphite in amounts of up to 12% by volume reduces the density of the alloy and therefore its weight as compared to denser materials with lower carbon content.

As previously indicated, the presence of various elements in the present metal alloy impacts on the strength and heat conductivity of the alloy. In particular, the metal alloy of the present invention contains controlled amounts of various elements to insure that a lightweight alloy is obtained with excellent strength and heat conductivity. In particular, the metal alloy of the present invention preferably contains from about 0.01 to 0.04% by weight of magnesium, and less than about 2.10% by weight of silicon.

Magnesium is maintained within the stated amounts to maintain the amount of nodular graphite and compacted graphite in the desired range. If the amount of magnesium falls below the minimum level, excess flake graphite is formed.

In cast ductile iron charges, the amount of silicon is generally in the range of from about 2.25 to 2.75% by weight. In the present alloy, it has been found that no more than about 2.10% by weight, preferably from about 1.50 to 1.80% by weight enables the alloy to attain acceptable heat conductivity.

Manganese is present in an amount of up to about 0.50% by weight, preferably in the range of from about 0.35 to 0.45% by weight which is less than customarily found in cast gray iron charges (i.e. from about 0.60 to 0.70% by weight). The amount of manganese is reduced over typical gray cast iron alloys so as to restrict the production of pearlite to within the desired range of up to about 50% by weight. If the amount of pearlite in the present alloy exceeds 50% by weight, the alloy becomes too brittle and is therefore not desirable for the formation of brake drums.

The maximum amount of sulfur in the present alloy is about 0.02% by weight. The preferred amount of sulfur is from about 0.005 to 0.007% by weight. The amount of sulfur tends to limit the formation of nodular graphite. In typical cast gray iron brake drum charges the amount of sulfur can be as high as about 0.13% by weight. Such high amounts of sulfur severely restrict the formation of nodular graphite and therefore render the resulting alloy lower in strength which is not acceptable for lightweight brake drums. It is therefore desirable to limit the presence of sulfur to ensure the presence of acceptable amounts of nodular graphite (i.e. at least 10% by weight of nodular graphite present in the alloy).

The amount of sulfur contained in the present alloy is controlled in part by employing the proper amount of magnesium. The presence of magnesium tends to reduce the amount of sulfur in the alloy by forming magnesium sulfide which is removed during alloy production. In addition, since some of the magnesium will be lost during pouring, the amount of magnesium provided to the alloy is usually greater than the amount of magnesium contained in the final alloy composition.

Phosphorus is limited in the present alloy to an amount of up to about 0.05% by weight. Phosphorus is limited in this manner because greater amounts of phosphorus, like manganese, tend to produce excess pearlite and make the alloy too brittle. The preferred amount of phosphorus is from about 0.018 to 0.028% by weight.

Chromium is another element that enhances the production of pearlite and carbide. It is therefore necessary to limit the amount of chromium to no more than about 0.10% by weight, preferably from about 0.05 to 0.07% by weight. The amount of chromium in the present alloy is far below the amount (i.e. from 0.12 to 0.18% by weight) typically found in cast gray iron charges. Carbides adversely affect the machinability of the alloy and retain carbon in a combined form. Carbon as free graphite is preferred to enhance heat conductivity of the alloy.

Copper is contained within the present alloy to provide strength. Typical cast gray iron charges contain up to 0.30% by weight of copper. However such amounts have shown to increase brittleness. In addition, copper is implicated in the formation of pearlite. Thus, it has been found desirable to limit the presence of copper to no more than about 0.20% by weight, preferably from about 0.08 to 0.11% by weight.

The availability of carbon or carbon equivalent is also an important feature of the present alloy. The carbon equivalent is based on the amount of carbon in the alloy plus ⅓ of the amount (weight) of silicon. It is desirable to have a carbon equivalent of up to about 4.7% by weight, preferably from about 4.1 to 4.7% by weight.

The alloy of the present invention exhibits excellent hardness, heat conductivity, tensile strength and yield strength. In particular, the hardness of the present alloy as measured by the Brinel Hardness scale is from about 143 to 217, preferably from about 156 to 187. The Brinel Hardness values mentioned above are determined by using a 10 mm diameter ball and a 3,000 kg load.

The minimum tensile strength of the present alloy is as previously indicated about 50,000 psi. Preferred tensile strengths are from about 55,000 to 78,000 psi. The minimum yield strength as measured at 0.2% offset is 35,000 psi, preferably from about 35,000 to 54,000 psi.

EXAMPLE 1

A charge weighing about 7,500 lbs. composed of the materials shown in Table 1 was placed into a cupola of a standard stacked furnace.

TABLE 1

| | |
|---|---|
| Plate steel scrap | 1,500 lbs. |
| Slitter scrap | 1,500 lbs. |
| Pig Iron | 1,000 lbs. |
| Cold Pressed Briquettes | 700 lbs. |
| Remelt | 1,800 lbs. |
| Limestone | 300 lbs. |
| Coke | 600 lbs. |
| 65% SiC Briquettes without manganese | 150 lbs. |

The cupola charge was heated to about 2700° F. until molten. A sample of the charge was taken and found to have the composition shown in Table 2. The molten charge was then transferred to a holding furnace.

TABLE 2

| C | Mn | Si | S | P | Al | Cr | Ni | Mo | Sn | Cu | Mg |
|---|---|---|---|---|---|---|---|---|---|---|---|
| CUPOLA IRON | | | | | | | | | | | |
| 3.50 to 3.80 | 0.30 to 0.45 | 1.00 to 1.35 | 0.05 to 0.08 | 0.018 to 0.028 | 0.008 to 0.013 | 0.04 to 0.05 | 0.03 to 0.04 | 0.01 to 0.02 | 0.01 to 0.02 | 0.10 to 0.12 | — |
| IRON IN HOLDING FURNACE | | | | | | | | | | | |
| 3.60 to 3.80 | 0.35 to 0.45 | 1.25 to 1.45 | 0.05 to 0.08 | 0.018 to 0.028 | 0.008 to 0.013 | 0.05 to 0.07 | 0.03 to 0.04 | 0.01 to 0.02 | 0.01 to 0.02 | 0.08 to 0.12 | — |
| IRON-AFTER FLUX AND GRAPHITE ADDITIONS, WIRE TREATMENT AND LADLE INOCULATION | | | | | | | | | | | |
| 3.75 to 3.95 | 0.35 to 0.45 | 1.50 to 1.80 | 0.005 to 0.007 | 0.018 to 0.028 | 0.012 to 0.014 | 0.05 to 0.07 | 0.03 to 0.20 | 0.01 to 0.02 | 0.003 to 0.006 | 0.08 to 0.11 | 0.01** to 0.04** |

*All amounts are in % by weight

**Magnesium content in the brake drum castings will be substantially lower

While in the holding furnace, the molten charge received a flux containing magnesium powder, silicon, one or more rare earth metals and graphite. Such a flux can be obtained from Globe Metallurgical Sales, Inc. The amount of the flux is typically from about 1 to 2 lbs. per 1,000 lbs. of molten charge. The graphite addition to raise carbon contains about 99.0% by weight of carbon and no more than 0.02% by weight of sulfur. The flux takes up impurities which float to the top of the molten charge and are eliminated therefrom.

In addition to the flux, the molten charge in the holding furnace was treated with about 40 lbs. of pure 25% by weight magnesium powder blended with 75% by weight of ferrosilicon in the form of 13 mm diameter cored wire to produce a nodular and compacted graphite containing iron having the composition shown in Table 2.

The thus treated iron was transferred to two pouring ladles. The iron in each ladle was inoculated with about 10 lbs. of 50% by weight of ferrosilicon at a temperature of from about 2,525° to 2,575° F.

The inoculated iron was poured into a mold such as a mold in the form of a brake drum. Each mold contained about 300 grams of semisintered ferrosilicon containing about 1.0% of magnesium. Nickel-magnesium alloy is added into the pouring ladles to compensate for the loss of magnesium during processing. Prior to cooling a sample of the alloy was taken and determined to have the composition shown in Table 2. After cooling, the molds were shaken to remove the brake drum.

A cast gray iron charge for the production of brake drums typically has the composition shown in Table 3.

TABLE 3

CUPOLA IRON-CAST GRAY IRON BRAKE DRUM CHARGE

| C | Mn | Si | S | P | Al | Cr | Ni | Mo | Sn | Cu | Mg |
|---|---|---|---|---|---|---|---|---|---|---|---|
| 3.50 to 3.70 | 0.60 to 0.70 | 1.40 to 2.00 | 0.10 to 0.13 | 0.05 to 0.06 | 0.010 to 0.015 | 0.12 to 0.18 | 0.08 to 0.10 | 0.03 to 0.04 | 0.01 to 0.03 | 0.25 to 0.30 | — — |

As shown by a comparison of Tables 2 and 3, the metal alloy of the present invention has a higher amounts of carbon and magnesium than typical cast gray iron. In addition, the present alloy contains lower amounts of manganese, sulfur, phosphorus, chromium, nickel, molybdenum and copper than typical cast gray iron. However, this alloy possesses higher strength than cast gray iron. As a result, the present alloy and structures made from the same (e.g. brake drums) are lighter in weight than cast gray iron yet possess acceptable strength and heat conductivity necessary for brake drums having a longer service life.

What is claimed is:

1. A metal alloy with a ferritic matrix having dispersed therein pearlitic iron and selected amounts of nodular, compacted and flake graphite comprising:

a) at least about 50% by weight of a ferritic matrix based on the total weight of the metal alloy;

b) not more than about 50% by weight of pearlitic iron based on the total weight of the metal alloy;

c) graphite comprising at least about 10% by weight of nodular graphite, compacted graphite, and flake graphite which is present in an amount of no more than about 20% by weight based on the total weight of graphite wherein the tensile strength of the metal alloy is at least about 50,000 psi; and d) less than about 2.10% by weight of silicon based on the total weight of the metal alloy.

2. The metal alloy of claim 1 wherein the amounts of nodular graphite and compacted graphite are about the same.

3. The metal alloy of claim 1 wherein the total amount of graphite is no more than about 12% by volume based on the total volume of the metal alloy.

4. The metal alloy of claim 3 wherein the total amount of graphite is from about 10 to 12% by volume based on the total volume of the metal alloy.

5. The metal alloy of claim 1 wherein the amount of silicon is from about 1.50 to 1.80% by weight based on the total weight of the alloy.

6. The metal alloy of claim 1 further comprising an amount at least one material selected from the group consisting of magnesium, manganese, sulfur, phosphorus, chromium and copper.

7. The metal alloy of claim 6 wherein the amount of magnesium is from about 0.01 to 0.04% by weight based on the total weight of the alloy.

8. The metal alloy of claim 6 wherein the maximum amount of manganese is about 0.50% by weight, the maximum amount of sulfur is about 0.02% by weight, the maximum amount of phosphorus is about 0.05% by weight, the maximum amount of chromium is about 0.10% by weight and the maximum amount of copper is about 0.20% by weight, based on the total weight of the metal alloy.

9. The metal alloy of claim 8 wherein the amount of manganese is from about 0.35 to 0.45% by weight, the amount of sulfur is from about 0.005 to 0.007% by weight, the amount of phosphorus is from about 0.018 to 0.028% by weight, the amount of chromium is from about 0.05 to 0.07% by weight and the amount of copper is from about 0.08 to 0.11% by weight, based on the total weight of the metal alloy.

10. The metal alloy of claim 1 having a minimum yield strength of about 35,000 psi.

11. The metal alloy of claim 1 having a Brinell Hardness of from about 143 to 217.

12. The metal alloy of claim 11 wherein the Brinell Hardness is from about 156 to 187.

13. The metal alloy of claim 1 wherein the carbon equivalent is up to about 4.7% by weight based on the total weight of the alloy.

14. The metal alloy of claim 1 wherein the carbon equivalent is from about 4.1 to 4.7% by weight.

15. The metal alloy of claim 1 wherein the amount of the ferritic matrix is from about 50 to 80% by weight.

16. The metal alloy of claim 1 wherein the amount of pearlitic iron is from about 20 to 50% by weight.

17. A metal alloy with a ferritic matrix having dispersed therein pearlitic iron and selected amounts of nodular, compacted and flake graphite comprising:

a) at least about 50% by weight of a ferritic matrix based on the total weight of the metal alloy;

b) not more than about 50% by weight of pearlitic iron based on the total weight of the metal alloy;

c) no more than 12% by volume of graphite based on the total volume of the metal alloy, said graphite comprising at least 10% by weight of nodular graphite, compacted graphite, and flaked graphite which is present in an amount of no more than about 20% by weight based on the total weight of graphite;

d) from about 1.50 to 2.10% by weight of silicon based on the total weight of the metal alloy; and e) up to about 0.50% by weight of manganese,
up to about 0.02% by weight of sulfur,
up to about 0.05% by weight of phosphorus,
up to about 0.10% by weight of chromium, and
up to about 0.20% by weight of copper,
based on the total weight of the metal alloy.

18. The metal alloy of claim 17 wherein the amount of manganese is from about 0.35 to 0.45% by weight, the amount of sulfur is from about 0.005 to 0.007% by weight, the amount of phosphorus is from about 0.018 to 0.028% by weight, the amount of chromium is from about 0.05 to 0.07% by weight and the amount of copper is from about 0.08 to 0.11% by weight, based on the total weight of the metal alloy.

19. A metal casting made of an alloy with a ferritic matrix having dispersed therein pearlitic iron and selected amounts of nodular, compacted and flake graphite comprising:

a) at least about 50% by weight of a ferritic matrix based on the total weight of the metal alloy;

b) not more than about 50% by weight of pearlitic iron based on the total weight of the metal alloy;

c) graphite comprising at least about 10% by weight of nodular graphite, compacted graphite, and flake graphite which is present in an amount of no more than about 20% by weight based on the total amount of graphite wherein the tensile strength of the metal alloy is at least 50,000 psi; and d) less than about 2.10% by weight of silicon based on the total weight of the metal alloy.

20. The metal casting of claim 19 in the form of a brake drum.

* * * * *